US005877659A

United States Patent [19]

Knowles et al.

[11] Patent Number: 5,877,659

[45] Date of Patent: Mar. 2, 1999

[54] 90° PHASE SHIFTER APPARATUS AND METHOD USING A DIRECTLY COUPLED PATH AND A SWITCHED PATH

[75] Inventors: Patrick Knowles, Severn; Timothy Waterman, Eldersburg, both of Md.

[73] Assignee: Northrop Grumman Corporation, Los Angeles, Calif.

[21] Appl. No.: 742,231

[22] Filed: Oct. 31, 1996

[51] Int. Cl.[6] ..... H01P 1/185

[52] U.S. Cl. ..... 333/164

[58] Field of Search ..... 333/164, 161, 333/104

[56] References Cited

U.S. PATENT DOCUMENTS 4,238,745 12/1980 Schwarzmann ..... 333/164

FOREIGN PATENT DOCUMENTS 305601 12/1989 Japan ..... 333/164

OTHER PUBLICATIONS

Hiller, Gerald; "Design with PIN Diodes, Part I"; *r.f. design;* Mar./Apr. 1979; pp. 34–47.

Richard C. Johnson, Antenna Engineering Handbook, Third Edition, 1961, pp. 20–41 and 20–42.

*Primary Examiner*—Benny Lee

*Attorney, Agent, or Firm*—Walter G. Sutcliff

[57] ABSTRACT

A method and apparatus for accomplishing a 90° relative phase shift employing a high characteristic impedance outer leg of length λ/2 and a low characteristic impedance through leg of length λ/4. The high characteristic impedance outer leg is directly connected to the input and the output. The low characteristic impedance through leg is connected to the input and output with first and second diode paths. When the first and second diode paths are in the on state, the low characteristic impedance through leg receives a majority of the input power. Because of the impedance disparity between the high characteristic impedance outer leg and low characteristic impedance through leg, only a small amount of power is routed through the high characteristic impedance outer leg when the first and second diode paths are in the on state and the combined signal phase is not substantially effected. When the first and second diode paths are in the off state, the input signal is routed through the high characteristic impedance outer leg. Because the relative lengths of the high characteristic impedance outer leg and the low characteristic impedance through leg differ by λ/4, a relative phase shift of 90° is provided at the output.

13 Claims, 2 Drawing Sheets

FIG. 1
PRIOR ART
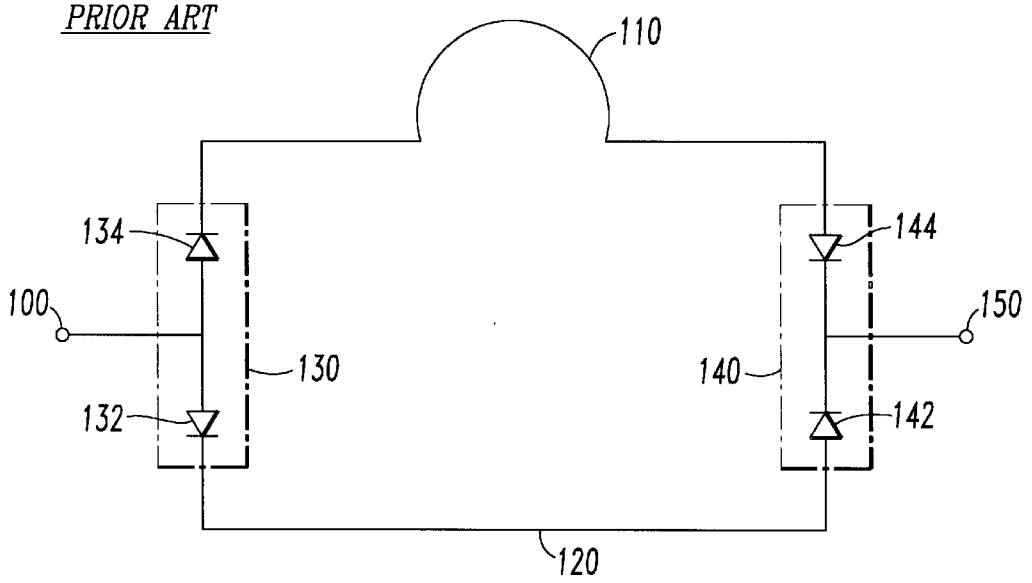
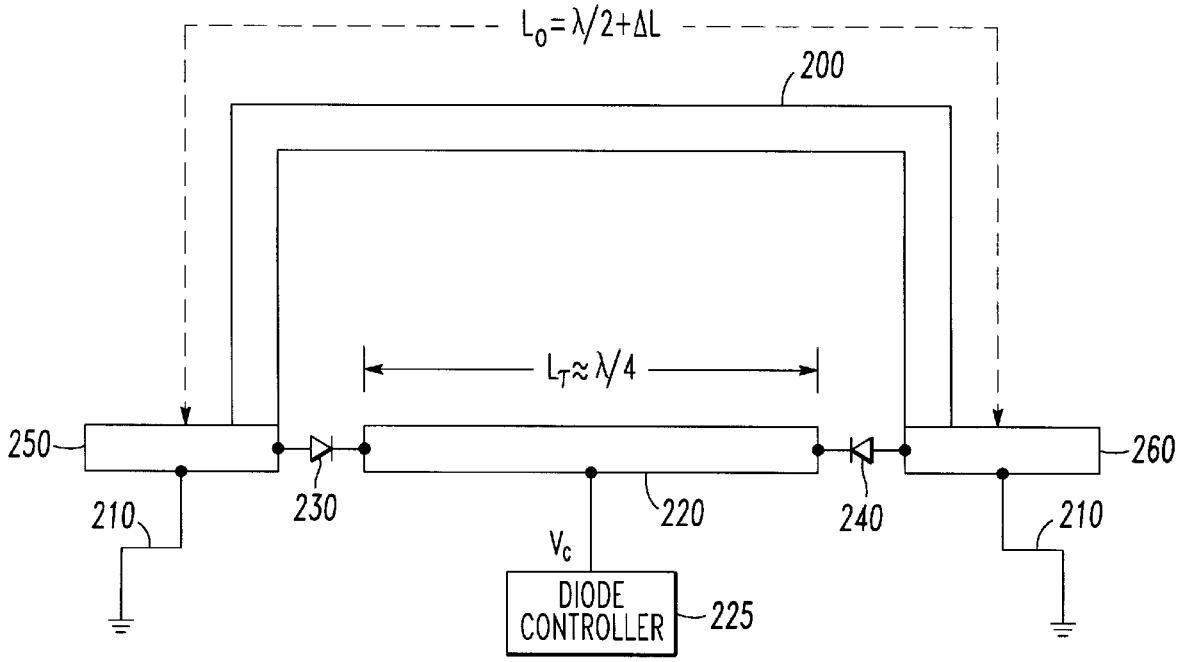
FIG. 2

FIG.3
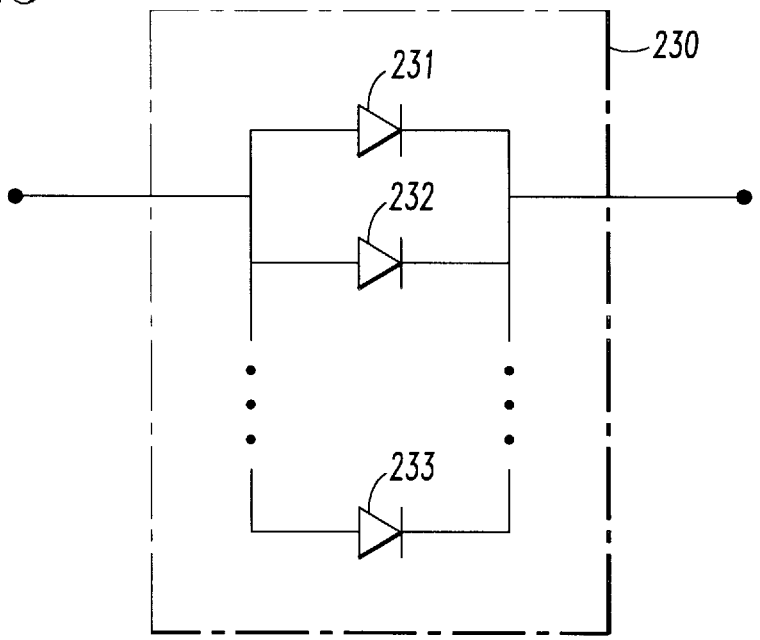
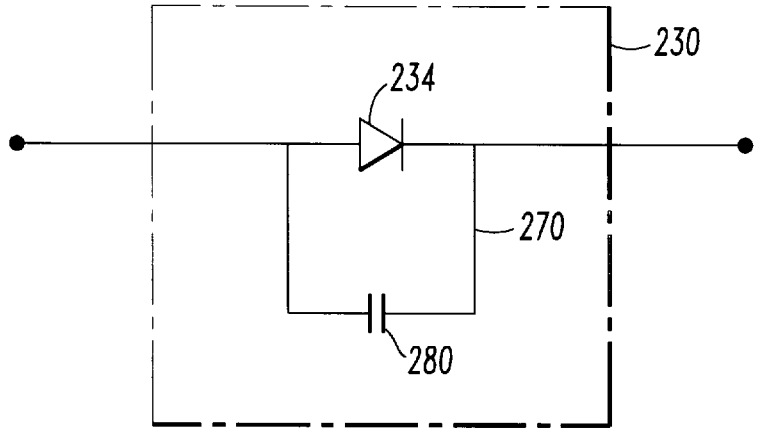
FIG.4

90° PHASE SHIFTER APPARATUS AND METHOD USING A DIRECTLY COUPLED PATH AND A SWITCHED PATH

FIELD OF THE INVENTION

This invention relates generally to electrical phase shifters and more particularly to a method and apparatus for shifting the phase of an input signal by 90°. Because phase shifting is used in a wide variety of fields, this invention has diverse applications, particularly to the field of communications, phased arrays and radars.

DESCRIPTION OF THE PRIOR ART

Phase shifting may be accomplished by a variety of devices and methods. One such technique is the switched-line phase bit shown in FIG. 1 and further described in Antenna Engineering Handbook, 3d Edition, pages 20-41 to 20-42 by Richard C. Johnson (1993). The switched-line phase shifter, as the name implies, consists of two phased delay lines 110, 120 and two single-pole, double-throw switches 130, 140. Each of the delay lines 110, 120, has a different phase length with the difference therebetween describing the relative phase of the circuit.

The delay line 110 is connected to the input 100 via diode switch 134 and to the output 150 via diode switch 144. Delay line 120 is connected to the input via diode 132 and to the output via diode 142.

When no relative phase shift is desired for the switched-line phase bit circuit shown in FIG. 1, diodes 132 and 142 are placed in the conducting state and diodes 134 and 144 are placed in the non-conducting state. When a relative phase shift is desired, diodes 134 and 144 are placed in the conducting state and diodes 132 and 142 are placed in the non-conducting state.

Thus, by controlling the conducting state of diodes 132, 134, 142 and 144, this circuit switches between delay line 110 and delay line 120. Hence, the name switched-line phase bit is commonly used to describe this circuit. To implement a desired relative phase, the relative lengths of delay line 110 and delay line 120 may be adjusted.

The switched-line phase bit circuit shown in FIG. 1 has the disadvantage that it requires a minimum number of four diode paths (132, 134, 142 and 144). Each of these diode paths (132, 134, 142 and 144) has an associated loss which reduces the amount of power supplied to the output 150 and, thereby, reduces the circuit's efficiency.

Furthermore, each diode leaks energy resulting in poor isolation between the input 100 and the output 150. Because the isolation of the diode junctions is poor, the reactance of this circuit cannot be matched out without some additional penalty of performance.

SUMMARY OF THE INVENTION

It is an object of the present invention, therefor, to provide an improvement in electrical phase shifters.

It is another object of the invention to provide an improvement in switched line phase shifters.

It is a further object of the invention to provide an improvement in diode controlled switched line phase shifters having low loss and a reduced number of diode paths.

According to the objects of the invention, a low loss phase shifting apparatus and method having a reduced number of diode paths is provided. In comparison with the background art shown in FIG. 1, two diode paths (diodes 134 and 144) are eliminated which reduces circuit energy losses and increases circuit isolation.

Briefly stated, the objects of the present invention are achieved by providing a phase shifter apparatus for shifting a phase of a signal having a wavelength $\lambda$ including a high characteristic impedance outer leg connected to an input and an output and having a length of approximately $\lambda/2$, a low characteristic impedance through leg having a length of approximately $\lambda/4$, a first diode path connecting the low characteristic impedance through leg to the input and a second diode path connecting the low characteristic impedance through leg to the output.

The objects of the present invention are further fulfilled by providing a diode controller selectively applying a diode control voltage to the first and second diode paths to selectively provide a current path through (1) the low characteristic impedance through leg and the high characteristic impedance outer leg or (2) only the high characteristic impedance outer leg.

The objects of the present invention are further fulfilled by providing an apparatus having a high characteristic impedance outer leg with a length that is $\lambda/2$ plus a diode leakage compensating length that compensates for phase errors caused by leakage of the first and second diode paths.

The objects of the present invention are further fulfilled by providing a phase shifting apparatus wherein the first diode path and/or second diode path include a plurality of diodes connected in parallel.

The objects of the present invention are further fulfilled by constructing the first diode path with a high characteristic impedance leakage path having a capacitor connected in parallel with a diode.

The objects of the present invention are further fulfilled by constructing the second diode path with a high characteristic impedance leakage path having a capacitor connected in parallel with a diode.

Another object of the present invention is fulfilled by providing a phase shifting method for shifting a relative phase of an input signal having a wavelength $\lambda$ including the steps of providing an input for an input signal having a first phase, providing an output for an output signal, shifting the first phase by 180° by directly connecting a high characteristic impedance outer leg having a length of approximately $\lambda/2$ to the input and the output, shifting the first phase by 90° with a low characteristic impedance through leg having a length of approximately $\lambda/4$, connecting the low characteristic impedance through leg to the input with a first diode path and connecting the low characteristic impedance through leg to the output with a second diode path.

The objects of the present invention are further fulfilled by providing a method having a step of applying a control voltage to the first and second diode paths sufficient to put the first and second diode paths in a conducting or non-conducting state to impart a relative phase shift of approximately 90° to the output signal.

The objects of the present invention are further fulfilled by providing a method having the step of adjusting the length of the high characteristic impedance outer leg to be $\lambda/2$ plus a diode leakage compensating length that compensates phase errors caused by leakage of the first and second diode paths.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 depicts a switched-line phase bit circuit from the background art;

FIG. 2 is a circuit diagram of the present invention;

FIG. 3 is an alternative circuit arrangement for diode paths; and

FIG. 4 shows another alternative circuit arrangement for diode paths.

DETAILED DESCRIPTION OF PREFERRED EMBODIMENTS

FIG. 2 shows a preferred embodiment of the present invention which is constructed by connecting a high characteristic impedance outer leg 200 to an input 250 and an output 260. Note that high characteristic impedance outer leg 200 is directly connected to input 250 and output 260 and that no diodes or other switching elements are used for these connections.

The high characteristic impedance outer leg 200 is constructed from a conductive material and has a length of $L_o$ that is approximately $\lambda/2$ where $\lambda$ is the wavelength of the input signal.

The circuit of FIG. 2 is further constructed by connecting a low characteristic impedance through leg 220 to input 250 via first diode path 230. The low characteristic impedance through leg 220 is also connected to the output 260 via second diode path 240.

The low characteristic impedance through leg is constructed with a conductive material and has a length $L_t$ that is approximately $\lambda/4$.

A diode controller 225, whose operation is described below, is connected to low characteristic impedance through leg 220. The input 250 and the output 260 are connected to ground 210.

An alternative circuit arrangement for the first diode path 230 is shown in FIG. 3. This alternative circuit configuration employs a plurality of diodes 231, 232 . . . 233 which are connected in parallel. A parallel connection of two or more diodes as shown in FIG. 3 is used in place of the first diode path 230 to reduce the loss of this element. This same circuit configuration may also be used for the second diode path 240.

Another alternative circuit configuration for the first diode path 230 is shown in FIG. 4. This circuit configuration adds a high characteristic impedance leakage path 270 and capacitor 280 that are connected in parallel to diode 234 as shown in FIG. 4. This alternative circuit configuration is useful when a non-PIN diode is employed. At certain frequencies, the high characteristic impedance leakage path and capacitor improves the circuit's operation. This same circuit configuration may also be used for the second diode path 240.

It is also possible to use the alternative circuit configurations shown in FIG. 3 and 4 in combination. In other words, a high characteristic impedance leakage path 270 and capacitor 280 may be placed in parallel across each of the diodes 231, 232 . . . 233 to further improve the operation of the first diode path 230. This combination may also be used for the second diode path 240.

OPERATION OF THE PREFERRED EMBODIMENT

The operation of the circuit shown in FIG. 2 will be described below.

The operation of the circuit is controlled with diode controller 225 which selectively applies control voltage $V_c$ (see FIG. 2) to the first and second diode paths (230, 240). When the control voltage $V_c$ is applied by diode controller 225, the first and second diode paths (230, 240) are placed in a conducting state. When the control voltage $V_c$ is not applied by diode controller 225, the first and second diode path (230, 240) are placed in a non-conducting state.

When the first and second diode paths (230, 240) are in the off or non-conducting state, the high characteristic impedance outer leg 200 having a length of approximately $\lambda/2$ conducts the majority of the signal through the outer leg. Because the high characteristic impedance outer leg 200 has a length of approximately $\lambda/2$, it behaves like a $\lambda/2$ transformer. As a $\lambda/2$ transformer, the high characteristic impedance outer leg 200 is by its very nature impedance matched.

In the ideal case, when the first and second diode paths (230, 240) are in the off state, all of the signal is conducted through the high characteristic impedance outer leg 200. In reality, the first and second diode paths (230, 240) are leaky and provide a current leakage path across through leg 220. This leakage current recombines as a small error in phase shift when the signals from the high characteristic impedance outer leg 200 and the low characteristic impedance through leg 220 recombine at the output 260.

The leakage current across through leg 220 when the first and second diode paths (230, 240) are in the off state may be corrected by adjusting the length of the high characteristic impedance outer leg 220. Thus, the length $L_o$ of the high characteristic impedance outer leg 220 may be adjusted to $\lambda/2$ plus $\Delta L$, where $\Delta L$ compensates for the current leakage across first and second diode paths (230, 240) when these diodes are in the off state.

When the first and second diode paths (230, 240) are in the on or conducting state, the input signal from input 250 is split into the high characteristic impedance outer leg 200 and the low characteristic impedance through leg 220. Because of the large, relative difference in characteristic impedance between the high characteristic impedance outer leg 200 and the low characteristic impedance through leg 220, most of the input power is channelled through the low characteristic impedance through leg. The large current vector provided at the output of the low characteristic impedance through leg is combined with a relatively small current vector at the output of the high characteristic impedance outer leg. Because the relative phase difference between the high characteristic impedance outer leg and the low characteristic impedance through leg is $\lambda/4$ or 90°, this vector summation is in quadrature and yields a vector with little or no amplitude degradation.

The small phase perturbation due to the outer leg's voltage combining with the through leg's voltage when the first and second diode paths (230, 240) are in the on state can easily be corrected by changing the inner to outer leg length (phase) ratio.

The above described preferred embodiment of the invention operates with minimal impedance mismatch and low current density. The preferred embodiment also incurs minimal loss between the input 250 and the output 260.

When the first and second diode paths (230, 240) are in the off state, very little power is leaked through the first and second diode paths (230, 240). Thus, the insertion loss of the present invention is very low. Furthermore, a reduced number of diode paths are needed in this invention when compared to the background art.

EXPERIMENTAL RESULTS

The preferred embodiment of the invention was experimentally tested by fabricating the circuit on a microstrip material having a permittivity $\epsilon_r$=2.55 and a loss tangent $\delta$=0.0022. This circuit was tested at S-band frequency. The measured insertion loss of the circuit was not greater than 0.45 db with a match less than 1.2:1.0. In comparison, the background art circuit had an insertion loss of approximately 0.75 db using the same microstrip materials. Thus, experimental results confirmed the theoretical improvements of the present invention over the background art.

Although microstrip fabrication techniques were used to test the invention, let it be understood that a variety of circuit construction techniques including waveguide, air, coax, A.D.S. (Air Dielectric Stripline) package, etc. may be used to construct the present invention.

Furthermore, a wide variety of diodes may be used for first and second diode paths (230, 240). The present invention is not restricted to PIN diodes, which have an intrinsic buffer zone and are generally used for RF circuits, and may be constructed with 914 diodes which are simple bipolar diodes and much cheaper than PIN diodes. When using the relatively inexpensive 914 diodes, it is generally advisable to use the alternative circuit configuration shown in FIG. 4 which provides a high characteristic impedance leakage path 270 and capacitor 280 in parallel with the diode to improve the circuit's performance. Because PIN diodes have very small leakages, the circuit shown in FIG. 4 is generally not required when using these diodes.

If a particular application of the inventive phase shifter disclosed herein is required to handle large amounts of power, a PIN diode may be used for first and second diode paths (230, 240).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A phase shifter for shifting a phase of an input signal having a wavelength $\lambda$ comprising:

an input, an output, a high characteristic impedance outer leg directly connected to said input and said output and having a length of approximately $\lambda/2$, a low characteristic impedance through leg having a length of approximately $\lambda/4$, a first diode path connecting said low characteristic impedance through leg to said input, and a second diode path connecting said low characteristic impedance through leg to said output.

2. The phase shifter of claim 1 further comprising:

a diode controller selectively applying a diode control voltage to said first and second diode paths.

3. The phase shifter of claim 1 wherein the approximately $\lambda/2$ length of said high characteristic impedance outer leg is $\lambda/2$ plus a diode leakage compensating length that compensates for phase errors caused by leakage of said first and second diode paths.

4. A phase shifting apparatus for shifting a relative phase of an input signal having a wavelength $\lambda$ comprising:

input means for providing the input signal having a first phase, output means for providing an output signal, high characteristic impedance outer leg means for shifting the first phase by 180° wherein said high characteristic impedance outer leg means is directly connected to said input means and said output means, a low characteristic impedance through leg means for shifting the first phase by 90°, first diode means connecting said low characteristic impedance through leg means to said input means, and second diode means connecting said low characteristic impedance through leg means to said output means.

5. The phase shifting apparatus of claim 4 further comprising:

diode control voltage means for selectively applying a diode control voltage to said first and second diode means.

6. The phase shifting apparatus of claim 4 wherein a length of said high characteristic impedance outer leg means is $\lambda/2$ plus a diode leakage compensating length that compensates for phase errors caused by leakage of said first and second diode means.

7. The phase shifting apparatus of claim 4 wherein said first diode means includes a plurality of diodes connected in parallel.

8. The phase shifting apparatus of claim 4 wherein said second diode means includes a plurality of diodes connected in parallel.

9. The phase shifting apparatus of claim 4 wherein said first diode means includes a high characteristic impedance leakage path having a capacitor connected in parallel with said first diode means.

10. The phase shifting apparatus of claim 4 wherein said second diode means includes a high characteristic impedance leakage path having a capacitor connected in parallel with said second diode means.

11. A phase shifting method for shifting a relative phase of an input signal having a wavelength $\lambda$ comprising the steps of:

providing an input for the input signal having a first phase, providing an output for an output signal, shifting the input signal having the first phase by 180° by directly connecting a high characteristic impedance outer leg having a length of approximately $\lambda/2$ to the input and the output, shifting the input signal having the first phase by 90° with a low characteristic impedance through leg having a length of approximately $\lambda/4$, connecting the low characteristic impedance through leg to the input with a first diode path, connecting the low characteristic impedance through leg to the output with a second diode path, and summing outputs of the high characteristic impedance outer leg and the low characteristic impedance through leg to provide an output signal.

12. The phase shifting method of claim 11 further comprising the step of:

applying a control voltage to the first and second diode paths to put the first and second diode paths in a conducting or non-conducting state to impart a relative phase shift of 90° to the output signal.

13. The phase shifting method of claim 11 further comprising the step of adjusting the approximately $\lambda/2$ length of said high characteristic impedance outer leg to be $\lambda/2$ plus a diode leakage compensating length that compensates for phase errors caused by leakage of the first and second diode paths.

* * * * *